US005424757A

United States Patent [19]

Thom

[11] Patent Number: 5,424,757

[45] Date of Patent: Jun. 13, 1995

[54] THERMAL PRINTER AND CASSETTE THEREFOR

[75] Inventor: Richard Thom, London, United Kingdom

[73] Assignee: Esselte Dymo N.V., St. Niklaas, Belgium

[21] Appl. No.: 795,325

[22] Filed: Nov. 20, 1991

[30] Foreign Application Priority Data

Nov. 20, 1990 [GB] United Kingdom ..... 9025242

[51] Int. Cl.[6] ..... B41J 2/325; B41J 25/304; B41J 25/316

[52] U.S. Cl. ..... 347/222; 400/120.1

[58] Field of Search ..... 346/76 PH; 400/120, 400/208

[56] References Cited

U.S. PATENT DOCUMENTS

| | | | |
|---|---|---|---|
| 4,272,202 | 6/1981 | Schroeder et al. | 400/208 |
| 4,632,585 | 12/1986 | Oyamatsu et al. . | |
| 4,750,008 | 6/1988 | Matsuura | 346/76 PH |
| 4,815,875 | 3/1989 | Richardson et al. | 400/208.1 |
| 4,944,619 | 7/1990 | Suzuki et al. . | |
| 4,966,476 | 10/1990 | Kuzuya et al. | 400/208 |
| 5,120,147 | 6/1992 | Ozaki | 400/120 |
| 5,165,806 | 11/1992 | Collins | 400/120 |
| 5,188,469 | 2/1993 | Nagao et al. | 400/120 |
| 5,193,919 | 3/1993 | Godo et al. | 400/120 |
| 5,222,818 | 6/1993 | Akiyama et al. | 400/120 |

FOREIGN PATENT DOCUMENTS

| | | | |
|---|---|---|---|
| 0267890 | 11/1987 | European Pat. Off. | B41J 25/30 |
| 0364305 | 10/1989 | European Pat. Off. . | |
| 0473147A2 | 3/1992 | European Pat. Off. | B41J 2/32 |
| 1-110180 | 4/1989 | Japan . | |
| 0063881 | 3/1990 | Japan . | |
| 2-63881 | 3/1990 | Japan | B41J 25/308 |
| 2136275 | 8/1990 | Japan . | |
| 3166977 | 10/1991 | Japan . | |
| 2162794 | 2/1986 | United Kingdom | B41J 32/00 |
| 2202797 | 10/1988 | United Kingdom | B41J 3/15 |
| 2234469 | 2/1991 | United Kingdom | B41J 15/00 |

*Primary Examiner*—Huan H. Tran
*Attorney, Agent, or Firm*—Pennie & Edmonds

[57] ABSTRACT

A printer comprises a cassette bay (8) having a lid (16), a printing mechanism comprising a thermal print head (26) and a platen (32) and a linkage (38,50) coupled between the lid and the printing mechanism. On opening the lid, the linkage causes the print head to adopt an inoperative position in which a cassette can be loaded into or removed from the cassette receiving portion and, on closing the lid, the linkage causes the print head to take up its operative position reading for printing. The invention also provides a cassette for the printer.

20 Claims, 5 Drawing Sheets

FIG.6.
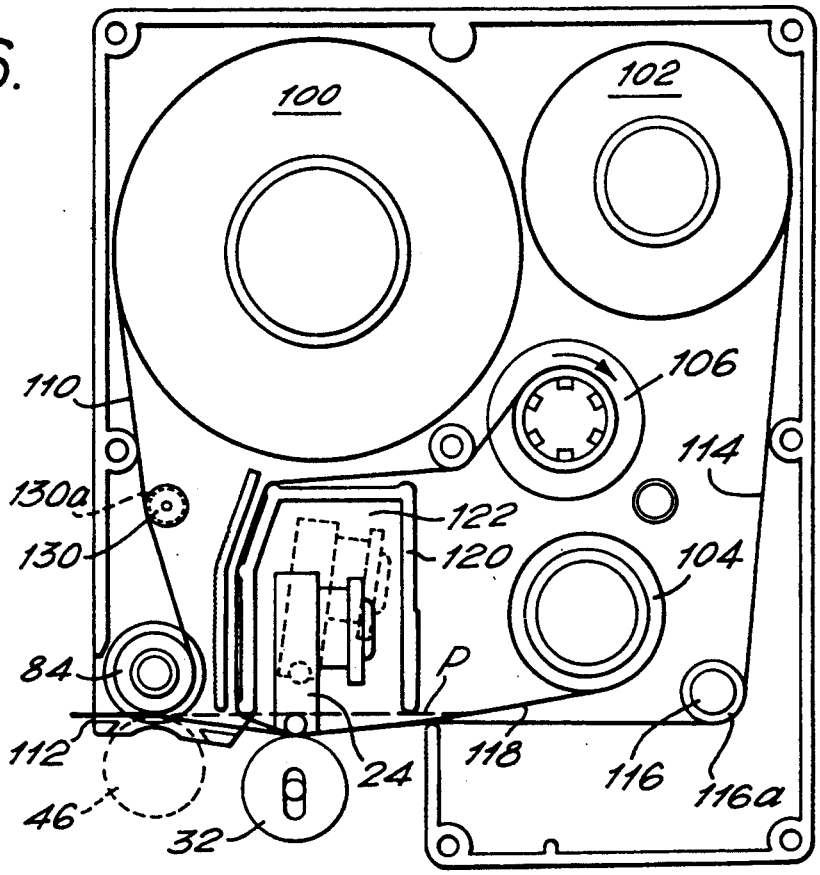
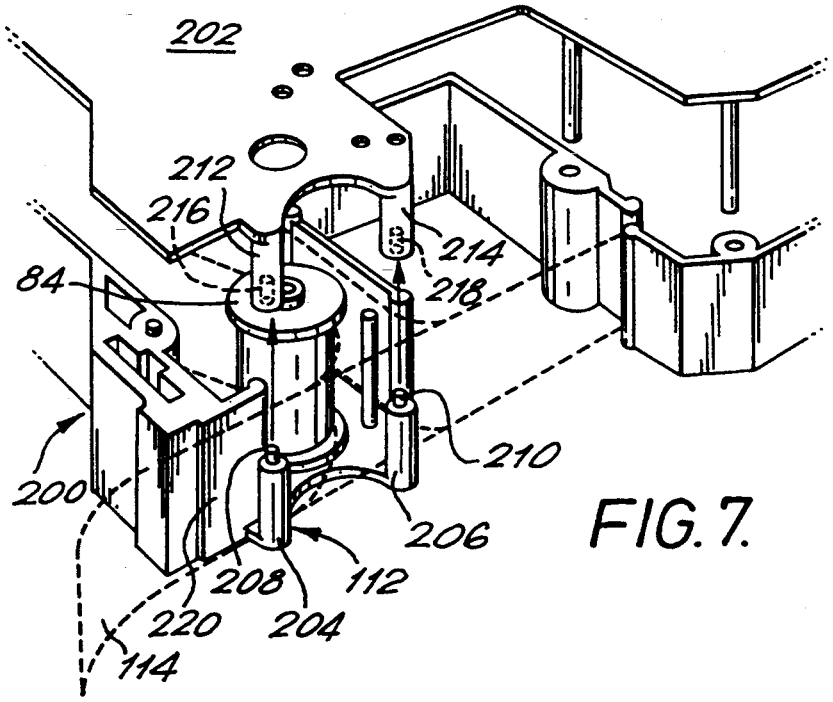
FIG.7.

THERMAL PRINTER AND CASSETTE THEREFOR

BACKGROUND OF THE INVENTION

This invention relates to a thermal printer and a cassette therefor.

A thermal printer is one in which printing is carried out using an electrically activated print head with a plurality of individually energisable heating elements which, when brought into contact with an ink ribbon and heated, transfer the ink from the ribbon to an image receiving tape in accordance with the data to be printed. A cassette carrying the ink ribbon and the image receiving tape is loaded into the printer so that the ink ribbon and image receiving tape are guided in overlap through a printing zone. During printing, the image receiving tape is held against the ink ribbon by a platen bearing against the print head and holding the ink ribbon and image receiving tape under pressure therebetween.

A thermal printer of this type is described in European Patent Application No. 0322919 in the name of Brother.

In this thermal printer, the printing zone is defined by a print head which is fixedly mounted in the printer and a platen which is moveable between a printing state in which the platen bears against the print head and an inoperative state in which the platen is spaced from the print head to define a gap to enable a cassette to be inserted with the image receiving tape and ink ribbon in overlap in the gap. The platen is mounted on a holder member which can be moved by a lever between the two states. The cassette for the thermal printer houses, in addition to the ink ribbon and image receiving tape, a spool carrying an adhesive backing layer which is applied to the printed surface of the image receiving tape after it has been printed and before it is fed out of the printer. This is accomplished by cooperation of a feed roller of the cassette and a drive roller mounted on the holder member. When the holder member is moved to bring the platen into its printing state the drive roller is brought into contact with the feed roller to form a nip to drive the printed tape from the printer which applied the adhesive backing layer.

One problem with this printer is the need to move the platen from its operative to its inoperative position by means of a manually operable lever before removing a cassette from the printer to replace it. If a user forgets to do this, and attempts to remove a cassette while the platen is in the printed state, damage to the printer and/or cassette is likely to result.

Furthermore, with the known printer, the cassette is loaded from underneath the printer, which can be inconvenient for a user.

SUMMARY OF THE INVENTION

One object of the invention is to overcome the difficulties referred to above. Another complication which arises in use of the known thermal printer affects the construction of the cassette. Printing is carried out in mirror image on one side of a transparent image receiving tape so that when viewed from the other side of the tape it appears to be the correct way round. The printed text can be viewed the correct way round as it emerges from the printer through the surface of the image receiving tape facing the user. To achieve this, the ink ribbon is housed within the cassette on the inner (printing) side of the image receiving tape. As the print head is fixed, this creates a difficulty on insertion of the cassette since the ink tape must be placed to lie between the print head and the image receiving tape and yet must not foul on the print head during insertion. To overcome this, the known cassette incorporates a biasing arrangment which holds the ink ribbon away from the print head on insertion.

Another object of the invention is thus to provide a cassette of simplified construction.

According to one aspect of the present invention there is provided a printer comprising a cassette receiving portion having a lid, a printing mechanism and a linkage coupled between the lid and the printing mechanism such that, on opening the lid, the linkage causes the printing mechanism to adopt an inoperative position in which a cassette can be loaded into or removed from the cassette receiving portion and, on closing the lid, the linkage causes the printing mechanism to take up its operative position ready for printing.

The printer preferably comprises on a surface thereof intended to face a user means for entering data to be printed. In that case the lid is provided on or adjacent that surface so that a user can insert and remove a cassette without having to turn over or otherwise move the printer.

In the described embodiment the printing mechanism comprises a thermal print head and a platen between which are held during printing an ink ribbon and an image receiving tape of the cassette. The thermal print head is movable between operative and inoperative positions automatically in response to opening and closing of the lid, while the platen remains fixed. In the operative position the thermal print head is out of contact with the platen to enable a cassette to be removed or inserted.

The coupling of the linkage directly to the lid of the cassette receiving portion has the advantage that, on opening the lid, the thermal print head is automatically caused to adopt its inoperative position ready to receive a cassette. It is thus not possible for a user to overlook the retraction of the print head and thereby cause damage to the cassette or printer.

In the described embodiment the linkage includes a cam coupled to the lid of the cassette receiving portion, the cam surface being in contact with one end of an actuation lever the other end of which is pivotably mounted to a bracket supporting the print head. As the point of contact of the cam surface with the actuation arm is altered in response to opening or closing of the lid, the bracket is pivoted into or out of the operative position respectively.

The printer is preferably capable of receiving cassettes which also include a spool of an adhesive backing layer. In that case the cassette has an output roller thereon which cooperates with a drive roller on the printer forming part of the printing mechanism to form a nip which applies the adhesive backing layer to the printed tape and drives it through the outlet of the printer. This drive roller can be driven by a drive system of the printer.

It is advantageous if the drive roller is brought into contact with the output roller simultaneously with the print head being brought into contact with the platen. Thus, in a preferred embodiment the linkage is so constructed that closure of the lid not only brings the print head into contact with the platen but also brings the drive roller into contact with the output roller. It will be appreciated that, when considering the path of the ink ribbon and tape through the printing zone, the requirement on opening the lid is to move the print head away from that path to one side of it and the drive roller away from that path to the other side of it, in a "scissor-type" action. In the described embodiment, the drive roller is mounted to a carriage which is pivotably mounted to the cassette receiving portion and has an arm which is coupled to the bracket which supports the thermal print head and is connected to the cassette receiving portion through biasing means in such a manner that on pivoting of the said bracket the carriage is caused to pivot to bring the drive roller into contact with the output roller.

The drive system of the printer can comprise a gear wheel for driving the output roller of a cassette adapted to mesh with a gear wheel fixedly mounted to the drive roller. The drive roller gear wheel can be arranged to be brought into and out of mesh with the gear wheel of the drive system in response to movement of the lid.

Preferably a further biasing means, such as a tension spring, is connected between the actuation arm and the cassette receiving portion in such a position relative to the hinge line of the lid with the cassette receiving portion that, with the lid in the closed position, the action of the further biasing means on the actuation arm against the action of the cam serves to maintain the lid in that position with the print head in the operative position and, with the lid in the open position, the torque provided by the further biasing means maintains the lid in the open position with the print head in the inoperative position.

The invention also provides in another aspect a cassette for a printer, the cassette having an ink ribbon supply spool and an ink ribbon rewind spool, the path of ink ribbon between the two spools being guided so as, when the cassette is disposed in a printer, to pass through a printing zone between a thermal print head and a platen of the printer, and an image receiving tape spool which is arranged to supply tape along a path at least a portion of which extends adjacent the path of the ink ribbon in the printing zone on the opposite face of the ink ribbon to that facing the print head, the cassette defining a recess sized to accommodate the thermal print head in both its inoperative and operative positions.

As the print head is moved into its inoperative position to enable the cassette to be removed, the image receiving tape, which had been under pressure against the platen moves away under its own resilience and adopts a path through the printing zone which maintains the ink ribbon out of contact with the platen and the thermal print head.

This removes the need for biasing means or other constructional features in the cassette designed to keep the ink ribbon out of contact with the platen and thermal print head when the cassette is to be replaced. Construction of the cassette is thus simpler and cheaper.

The cassette preferably has a base part for supporting the image receiving tape spool and comprising a first guide member defining with a wall region of the base part a slot for receiving tape from the tape spool; and a closure member comprising a second guide member which is arranged to mate with said first guide member to form an enclosed guide for the tape.

With this arrangement, the assembly of the cassette is simplified since it is not necessary to thread the tape through an enclosed guide but merely to slot it into the gap between the wall region of the base part and the first guide member, which holds the tape in place. The second guide member then mates with the first guide member to enclose the ribbon.

The base part may have a third guide member arranged to mate with a fourth guide member on the closure member to define a second enclosed guide as an outlet of the cassette through which the printed tape and the adhesive backing layer is passed.

Reference is made to U.S. patent application Ser. No. 917,138, which describes a control system for operating the printer.

BRIEF DESCRIPTION OF THE DRAWINGS

For a better understanding of the present invention, and to show how the same may be carried into effect, reference will now be made, by way of example, to the accompanying drawings, in which:

FIG. 6 is a plan view of a cassette for insertion into the thermal printer;

FIG. 7 is a perspective view of part of the cassette housing; and

DESCRIPTION OF THE PREFERRED EMBODIMENTS

Figure 1:
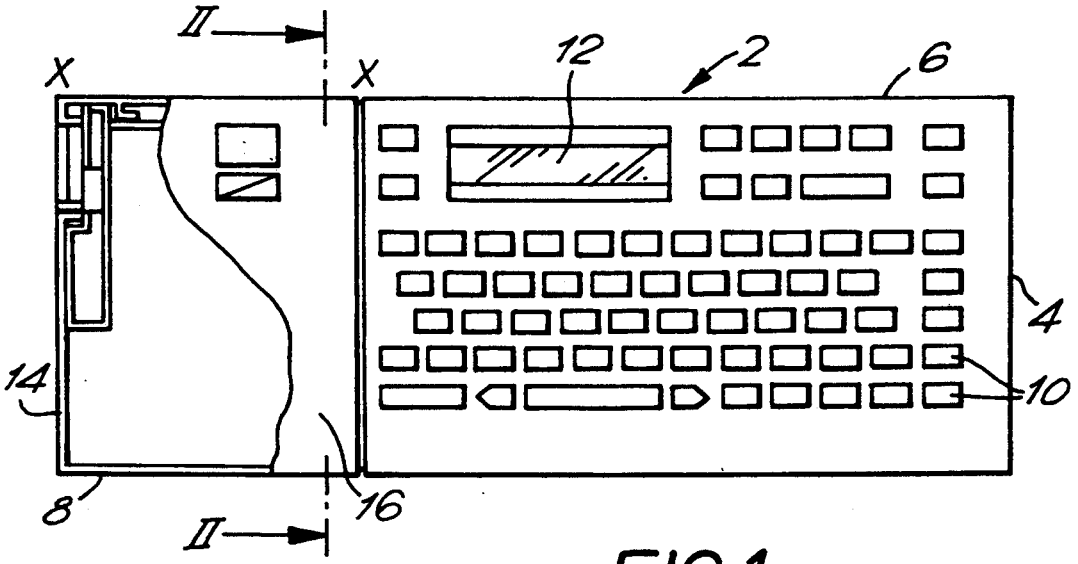
FIG. 1 is a plan view of a thermal printer.

FIG. 1 is a plan view of a thermal printer 2 comprising a casing 4 which has a right hand part 6 housing electronic circuitry for controlling operation of the printer and a left hand part acting as a cassette bay 8 and housing a printing mechanism. The right hand part 6 carries keys 10 for entering print data into the thermal printer and a display screen 12 for displaying the entered print data prior to printing. The cassette bay 8 comprises a casing base 14 and a lid 16. The lid 16 is shown cut away in FIG. 1 to reveal details of part of the printing mechanism which will be described in more detail hereinafter.

Figure 2:
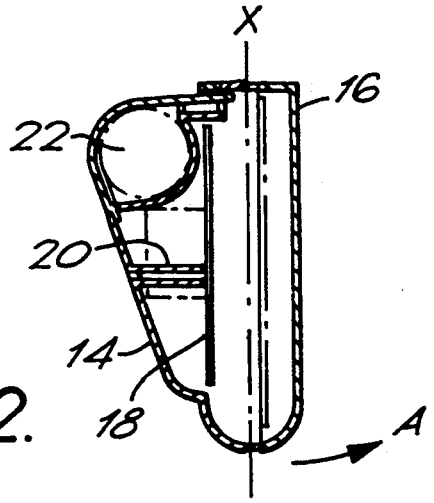
FIG. 2 is a section along line II—II in FIG. 1.

Referring now to FIG. 2, it can be seen that the lid 16 is hingedly connected to the casing base 14 along hinge line x—x. The lid opens in the direction of arrow A to reveal a chassis 18 for receiving a cassette for the thermal printer 2. The chassis 18 is supported on the base 14 by a chassis mounting boss 20 and extends forwardly at an angle relative to the base 14. In FIG. 2, reference numeral 22 designates a battery for the printer 2.

Figure 3:
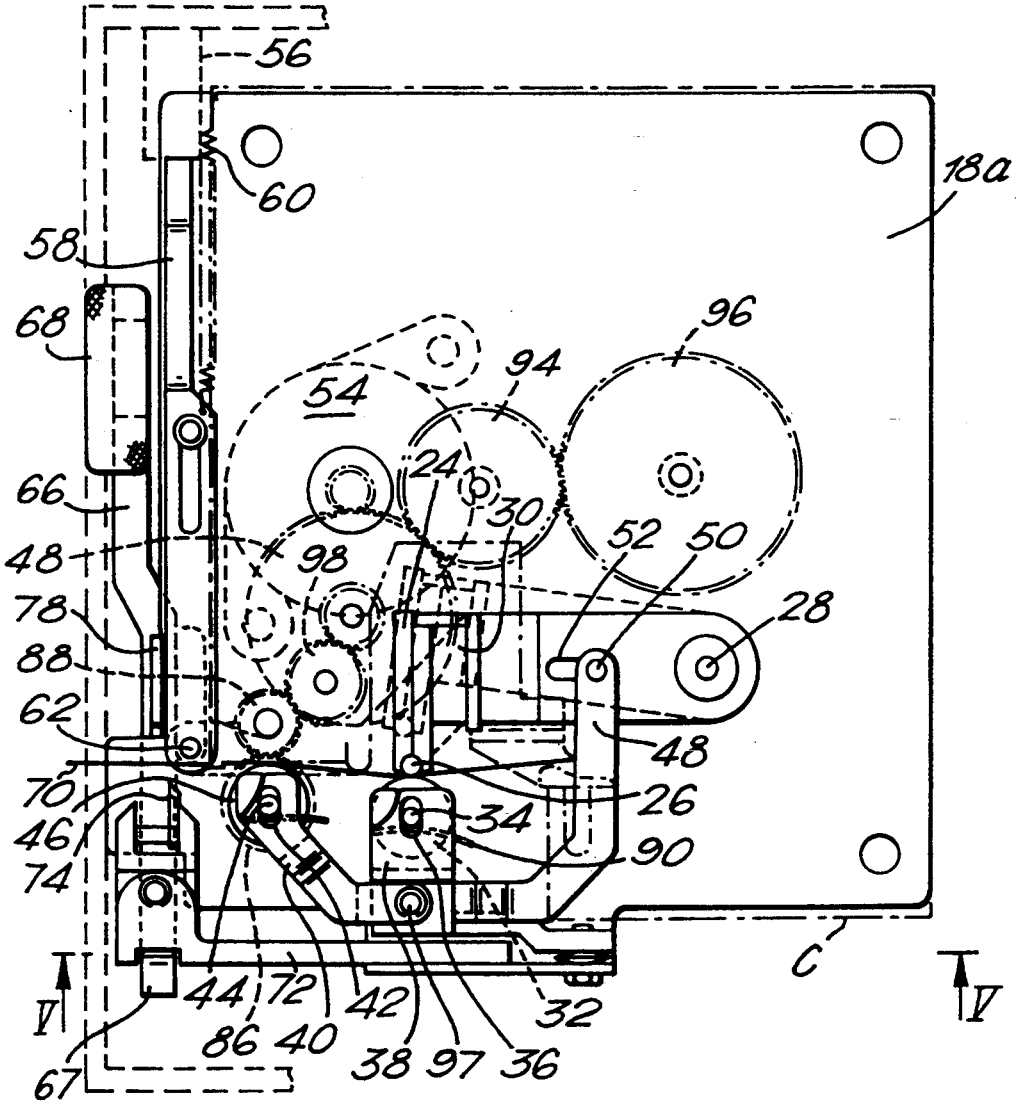
FIG. 3 is a plan view of the cassette receiving portion of the printer with the lid having been removed.

FIG. 3 is a plan view of the printing mechanism, shown looking down on the cassette bay 8 of FIG. 1 with the lid 16 having been removed. The printing mechanism comprises a thermal print head 24 which can for example be of the type comprising an elongate glass rod 26 (extending into the plane of the paper in FIG. 3) carrying a row of thermally activatable heating elements. This type of thermal head is known and can be obtained from SUSUMU CO. LTD., PART NO. TE5-GA006401-0114. It will be apparent that other types of print head can be used with the present invention. There is formed below the cassette chassis 18 a pressed steel baseplate 18*a*. To this baseplate is mounted a linkage mechanism actuating the thermal print head 24 and a drive roller 46. The print head 24 is secured to a print head support bracket 30 which pivots about a pin 28 secured to the baseplate 18*a* between an operative position, shown in FIG. 3, and an inoperative position shown in broken lines in FIG. 3. In the operative position the glass rod 26 of the print head 24 bears against a platen 32 which is spring loaded towards the thermal print head 24 by a spring 90. The spring 90 gives the correct contact pressure of the platen against the print head, as specified by the manufacturer of the print head. When a cassette is loaded in the cassette chassis 18, printing tape 70 passes between the print head 24 and platen 32 as will be described more particularly hereinafter. The platen 32 is rotatably mounted on a pin 34 secured to the baseplate 18*a* the upper end of which pin is guided in a slot 36 of a first roller cage 38. A second roller cage moulding 40 is pivotably mounted at a pivot point 97 adjacent the first roller cage 38. The second cage moulding 40 has upper and lower slots, the upper one of which is designated 42, in which is guided a pin 44 which can move backwards and forwards within those slots. The drive roller 46 is secured to the pin 44 and rotates therewith. There is also secured to the pin 44 a gear wheel 86 by means of which the drive roller 46 is driven by a gear train to be described. The other end of the second roller cage moulding 40 has a pin 50 guided in a slot 52 of the print head support bracket 30.

The second roller cage moulding is connected by a tension spring 92 (shown in FIG. 8*b*) to the baseplate 18*a*.

Figure 5:
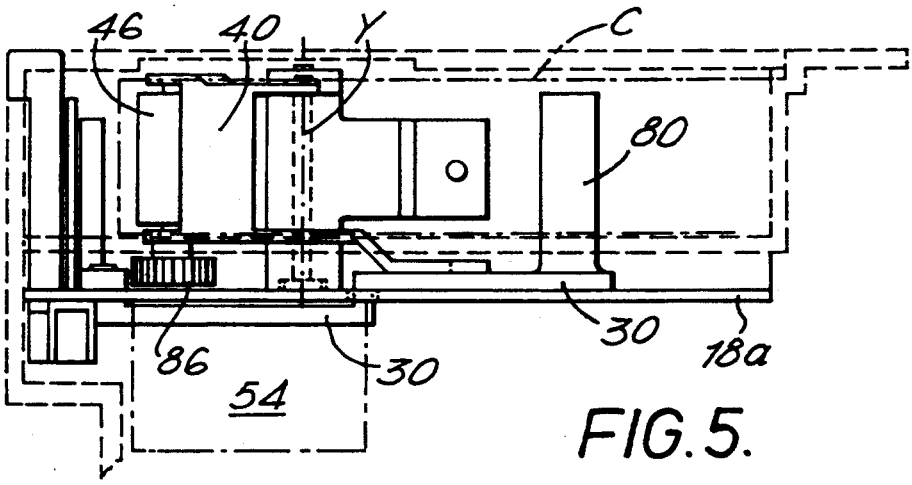
FIG. 5 is a view taken from the front of FIG. 3.

The print head support bracket 30 doglegs through the baseplate 18*a* (as can be seen in FIG. 5) and is pivotably connected via a pin 62 to an actuation arm 58 of the linkage mechanism.

Figure 4:
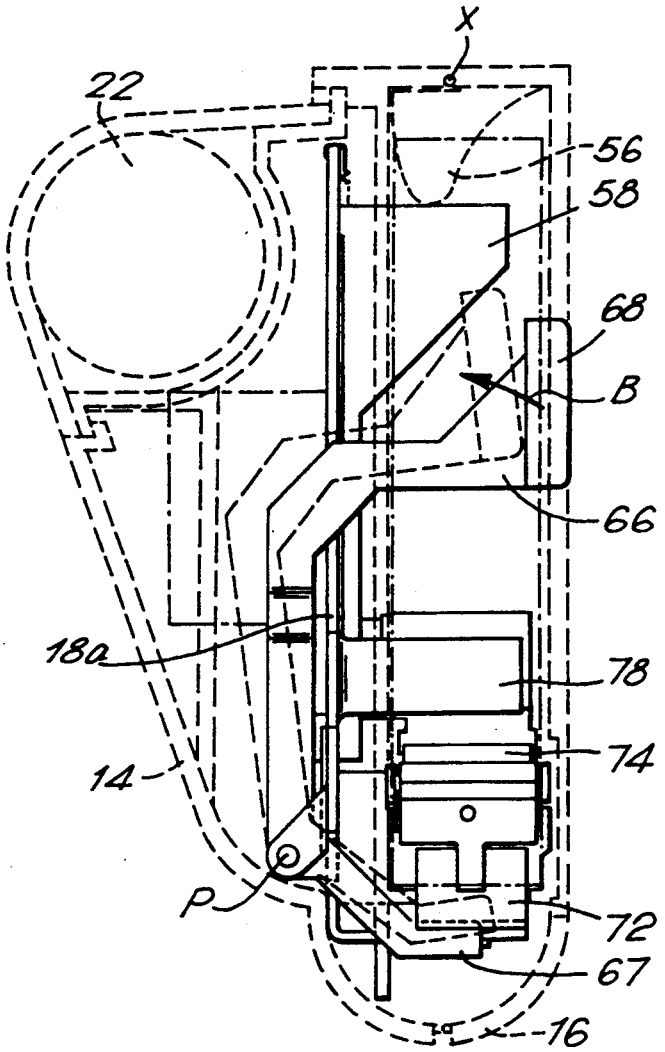
FIG. 4 is a view taken from the side of FIG. 3.

Reference will now be made to FIGS. 3 to 5 to describe the linkage mechanism operable to move the print head 24 and drive roller 46 when the lid 16 is open and closed. The lid 16 carries a cam 56 which bears against the print head actuation arm 58. The contact point of the cam 56 with the print head actuation arm is shown in the position with the lid closed in FIG. 4. The print head actuation arm 58 can slide relative to the baseplate 18*a* in response to the movement of the cam 56 when the lid is opened or closed. In the closed position the print head actuation arm 58 is biased towards the cam 56 by the action of a spring 60. The action of this spring 60 will be described in more detail hereinafter, with the operation of the linkage mechanism.

FIG. 4 also illustrates a cutting mechanism for the printer 2. The cutting mechanism comprises a cutting arm 66 carrying on one end a button 68 to be depressed by a user when the tape 70 is to be cut. The cutting arm 66 is pivotably mounted at a pivot point P so that when the button 68 is depressed in the direction of arrow B the other end 67 of the cutting arm is brought into contact with a cutter support 72 which carries a cutting blade 74. The blade 74 acts against the cassette which is held in place by a turned up region 78 of the edge of the baseplate.

FIG. 5 shows the interconnection between certain elements of the printing mechanism more clearly. The feed roller 46 can be seen to be rotatably mounted in the second roller cage moulding with the gear wheel 86 mounted below it. FIG. 5 also shows that the pin 28 extends upwardly to lend rigidity to the pivoting components and serves as a support for a spool of a cassette inserted into the printer 2. The outline of a cassette is shown by a broken line designated C in FIGS. 3 and 5.

The drive system and gear train for the printer will now be described. A motor 54 is located beneath the baseplate and drives a double spur gear 48. The larger diameter spur gear drives, via an intermediate gear 94, a gear 96 which drives a ribbon rewind spool of a cassette inserted into the printer. The smaller diameter spur of the double spur gear 48 drives a gear 98 which drives a gear 88 which is mounted on the same pin as an output roller of the cassette. The output roller acts with the drive roller 46 in its operative position to form a nip which applies an adhesive backing layer to the printed tape and causes the tape to be driven out of the printer. The gear 88 meshes with the gear 86 of the drive roller 46 when the latter is in the operative position.

FIG. 6 shows a plan view of a cassette loaded in the cassette bay 8, with the lid of the cassette removed. The cassette comprises a spool 100 of an adhesive backing tape 110, a spool 102 which supplies a transparent image receiving tape 114, an ink ribbon supply spool 104, an ink ribbon rewind spool 106 and an output roller 84. The backing tape 110 extends from the backing tape spool 100 around the output roller 84 and from there to the outlet 112 of the cassette. The image receiving tape 114 extends from its spool 102, around a guide 116, between the print head 24 and the platen 32, between the output roller 84 and drive roller 46 and to the outlet of the cassette.

The path of the backing tape is such that a guide 130 is needed. The backing tape has an adhesive layer on its outer surface with a releasable backing layer secured thereto and an adhesive layer on its inner side (facing the guide 130). To avoid adhesion of the tape to the guide 130, and consequent disruption to operation, the guide 130 has a plurality of circumferential notches or grooves 130*a* to reduce the area of the guide in contact with the tape.

The ink ribbon 118 runs from the supply spool 104, through a printing zone 122 between the print head 24 and the platen 32, round a guide 120 in the cassette which defines a recess delineating the printing zone 122 and finally to the ink ribbon to take up spool 106. The recess in the cassette accommodates the thermal print head and is large enough to accommodate movement of the print head into and out of the operative position.

In use an image is printed onto the surface of the image receiving tape facing the ink ribbon as a mirror image so that when viewed towards the other surface of the image receiving tape it is viewed the correct way round.

The ink receiving tape is made of transparent polyester about 50 μm thick. The span of the ink ribbon 118 between the supply spool 104 and the output roller 108, and the resilience of the image receiving tape 114 is such that, when the lid 16 is opened and the print head 24 returns to its inoperative position, the tape 114 returns under its own resilience to adopt a path (indicated by a broken line marked P in FIG. 6) out of contact with both the print head 24 and the platen 32. As the ink ribbon 118 lies behind image ink receiving tape, it is carried with the image receiving tape 114 to adopt the path P. In this way the ink ribbon is maintained out of contact with the print head and platen when the print head is in the inoperative position without the need for a biasing mechanism in the cassette to accomplish this objective.

FIG. 7 illustrates part of the cassette housing in a perspective view. The housing comprises a base part 200 and a closure member or lid 202. The base part 200 has two lower guide posts 204,206 each carrying a respective peg 208,210. The lid of the cassette 202 has two cooperating upper guide posts 212,214 which have central passages 216,218 for receiving respectively the pegs 208,210. The posts 206,214 define an enclosed guide through which the image receiving tape is passed. The posts 204,212 define a second guide through which image receiving tape and the adhesive backing layer are guided. On assembly of the cassette, the lower guide posts 204,206 define with wall regions 220,221 of the cassette housing slots to hold the ends of the tapes in place at the outlet 112. The lid 202 is then put in place so that the upper and lower guide posts mate to form enclosed guides for the tape.

Figure 8A:
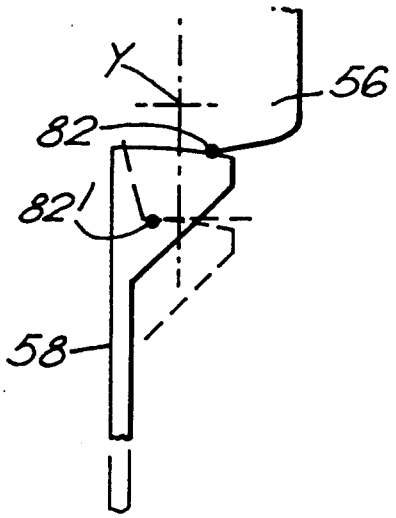
FIGS. 8*a* and 8*b* illustrate the operation of the linkage between the lid and the printing mechanism.

It is an important feature of the thermal printer 2 described herein that, as the lid 16 is opened, the thermal print head 24 is moved automatically from the operative position to the inoperative position. The manner in which this is achieved will now be described with reference to FIGS. 8*a* and 8*b*, which are schematic diagrams showing only those elements forming part of the linkage mechanism which achieves this result. The elements themselves have been described above with reference to FIGS. 3 to 5. The linkage mechanism has two important functions.

Firstly, when the lid is in the open position, the cam 56 contacts the actuation arm 58 at a contact point 82 which lies above the hinge line x—x. In this disposition the tension spring 60 exerts an anticlockwise torque about the hinge line and serves to keep the lid 16 in the open position. In contrast, when the lid 16 is in the closed position, the point of contact 82' between the cam 56 and the actuating arm 58 is now below the hinge line x—x so that the spring 60 exerts a clockwise torque about the hinge, against the action of the cam against the actuation arm serving to keep the lid closed. In FIG. 6*a*, the full line denotes the open position of the lid 16 and the dotted line denotes the closed position.

This arrangement of cam and spring ensures that the lid 16 is always maintained in the required position (open or closed) by positive spring action. There is therefore no need for a user to have to hold the lid open during insertion of a cassette or to worry about the lid 16 inadvertently opening during operation of the printer.

Figure 8B:
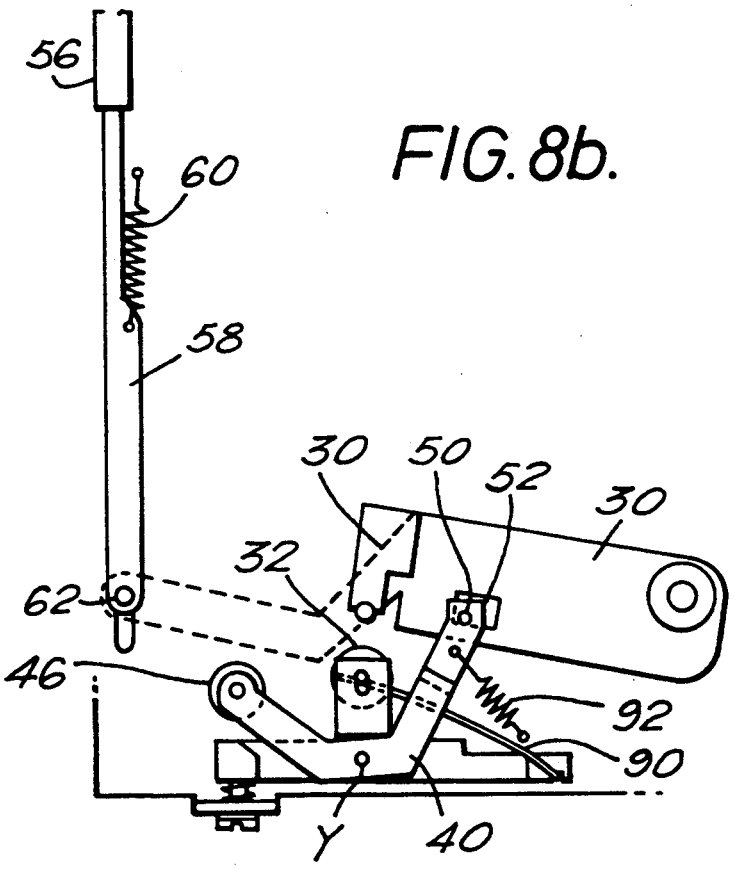

Secondly, the drive roller 46 and print head 24 are brought into and out of the operative positions automatically in response to closing and opening the cassette. The position with the lid open is shown in FIG. 8*b*.

When the lid 16 is closed, the action of the cam 56 causes the actuation arm 58 to move forwardly (downwardly in FIG. 8*b*) bringing with it the print head support bracket 30 which pivots about the pin 62. The print head 24 is thus brought into contact with the tape 70 (not shown in FIG. 8*b*) and presses the tape 70 against the platen 32. As the print head support bracket 30 pivots about the pin 28, the spring 92 will cause the moulding 40 to move clockwise because the slot 52 moves to the right in FIG. 8*b*. The roller cage moulding 40 therefore rocks about pivot point Y to cause the driver roller 46 to move upwardly in FIG. 8*b* bringing it into contact with the output roller 84 of the cassette and bringing its gear wheel 88 in the gear train of the printing mechanism.

The slot 52 is oversized so that as the drive roller 46 contacts the output roller 84, the pin 50 will drift. The bracket 30 continues to move without now moving the cage moulding 40. The drive roller 46 is held against the output roller 84 by the spring 92. On opening the lid, the motions are reversed to bring the print head 24 and roller 48 into their inoperative positions.

I claim:

1. A printer comprising a cassette receiving portion having a lid, a printing mechanism comprising first and second cooperating printing elements, and a printing mechanism control arrangement operable such that, on opening the lid, the printing mechanism is caused to adopt an inoperative position in which a cassette can be loaded into or removed from the cassette receiving portion, wherein the first printing element is carried by a support member which is pivotably movable between the inoperative position and an operative position ready for printing, and the printing mechanism control arrangement comprises: an actuation member having a first end arranged to be operated by the lid and a second end connected to said support member so that when the lid is closed the support member and first printing element are pivoted from the inoperative position to the operative position; and a biasing element connected between the actuation member and the cassette receiving portion such that when the lid is open the support member is biased in the inoperative position and the lid is maintained in the open position and when the lid is closed, the action of the biasing element maintains the lid in the closed position with the first printing element in the operative position.

2. A printer as claimed in claim 1, wherein the first printing element comprises a thermal printhead and the second printing element comprises a platen between which are held during printing an ink ribbon and an image receiving tape of the cassette, whereby the thermal printhead is movable between the operative and inoperative positions in response to opening and closing of the lid.

3. A printer as claimed in claim 1 in which the lid comprises a cam having a cam surface in contact with the first end of the actuation member and the second end of the actuation member being pivotably mounted to the support member whereby as the contact of the cam surface with the actuation member is altered in response to opening or closing of the lid, the support member is pivoted into or out of the operative position respectively.

4. A printer as claimed in claim 3 wherein the lid is hingedly connected to the cassette receiving portion along a hinge line, and the contact of the cam surface with the actuation member lies above the hinge line when the lid is in the open position, and lies below the hinge line when the lid is in the closed position.

5. A printer as claimed in claim 1, wherein the support member comprises a bracket.

6. A printer as claimed in claim 1, further comprising on a working surface thereof intended to face a user means for entering data to be printed, the lid being provided on or adjacent the working surface.

7. A printer as claimed in claim 1, wherein the printing mechanism includes a drive roller which serves to drive the tape once printed through an outlet of the thermal printer, the drive roller being brought into its operative position when the lid of the printer is closed.

8. A printer as claimed in claim 7, wherein the drive roller is mounted to a carriage which is pivotably mounted to the cassette receiving portion and includes an arm which is coupled to the support member, the roller being connected to the cassette receiving portion through biasing means such that on pivoting of the support member the carriage is caused to pivot to bring the drive roller into an operative position in contact engagement with an output roller of a cassette that is located in the cassette receiving portion.

9. A printer as claimed in claim 1, wherein the lid is hingedly connected to the cassette receiving portion along a hinge line.

10. A printer as claimed in claim 1 in combination with a cassette comprising an ink ribbon, an ink ribbon supply spool and an ink ribbon rewind spool, means for guiding the path of the ink ribbon between the two spools so that the ink ribbon passes between the first and second cooperating printing elements, and an image receiving tape spool which is arranged to supply tape along a path at least a portion of which extends adjacent the path of the ink ribbon between the ink ribbon and the first printing element, the cassette defining a recess sized to accommodate the first printing element of the printer in both its operative and inoperative positions.

11. A printer as claimed in claim 1 wherein the first printing element includes a print head.

12. A printer as claimed in claim 1 wherein the second printing element comprises a platen movably mounted on the cassette receiving portion and biased towards the first printing means by a second printing element biasing means.

13. A printer as claimed in claim 1 further comprising a housing which includes the cassette receiving portion and further portions adapted to receive batteries for powering the printer, keys for entering print data, and display means for displaying entered print data.

14. A printer comprising a housing which includes a cassette receiving cavity, a lid operable between open and closed positions for substantially covering said cavity, a printing mechanism comprising a support member and first and second cooperating printing elements, with the first printing element mounted upon the support member, and a printing mechanism control arrangement operatively associated with said lid for positioning said first printing element and support member in a first position where the first printing element is retained sufficiently apart from the second printing element to allow a cassette to be loaded into or removed from the cassette receiving cavity, and a second position where the first printing element is retained adjacent the second printing element in operative relation ready for printing, said printing mechanism control arrangement comprising an actuation member having a first portion operatively associated with the lid and a second portion operatively associated with support member and a biasing element connected between the actuation member and the cassette receiving portion so that, when the lid is open, the printing elements are retained in the first position by the biasing element and when the lid is closed, the support member and first printing element are moved to the second position and retained in that position by the biasing element.

15. A printer as claimed in claim 14 wherein the first printing element includes a print head.

16. A printer as claimed in claim 14 wherein the support member is pivotably movable between the first and second positions.

17. A printer as claimed in claim 14 in which the lid comprises a cam having a cam surface in contact with the first end of the actuation member and the second end of the actuation member is pivotably mounted to the support member, whereby as the contact of the cam surface with the actuation member is altered in response to the opening or closing of the lid, the support member is pivoted into or out of the operative position, respectively.

18. A printer as claimed in claim 14 wherein the lid is hingedly connected to the housing along a hinge line, and the contact of the cam surface with the actuation member lies above the hinge line when the lid is in the open position, and lies below the hinge line when the lid is in the closed position.

19. A printer as claimed in claim 14 wherein the second printing element comprises a platen movably mounted on the cassette receiving portion and biased towards the first printing means by a second printing element biasing means.

20. A printer as claimed in claim 14 wherein the housing further includes portions adapted to receive batteries for powering the printer, keys for entering print data, and display means for displaying print data.

* * * * *